United States Patent [19]

Wang

[11] Patent Number: 4,932,660

[45] Date of Patent: Jun. 12, 1990

[54] GOLF PRACTICE DEVICE

[76] Inventor: Austin Wang, 6F, No. 24, Ting-Mu E. Road, Taipei, Taiwan

[21] Appl. No.: 321,986

[22] Filed: Mar. 10, 1989

Related U.S. Application Data

[63] Continuation-in-part of Ser. No. 224,124, Jul. 25, 1988, abandoned.

[51] Int. Cl.[5] ..... A63B 69/36

[52] U.S. Cl. ..... 273/185 D; 273/200 B; 273/197 A; 273/58 C

[58] Field of Search ..... 273/185 D, 200 R, 185 C, 273/200 B, 197 R, 197 A, 198, 58 C

[56] References Cited

U.S. PATENT DOCUMENTS 1,419,636 6/1922 MacDonald ..... 273/185 D

FOREIGN PATENT DOCUMENTS 1263269 2/1972 United Kingdom ..... 273/185 D

*Primary Examiner*—George J. Marlo
*Attorney, Agent, or Firm*—Leonard Bloom

[57] ABSTRACT

A golf practice device for a player to improve the player's swing of a golf club by striking a practice golf ball and observing the controlled movement of the practice golf ball. The device includes a base, an inverted L-shaped support having a horizontal portion and a mechanism for suspending the practice golf ball from the support. A member rotatable about a horizontal axis is mounted on the horizontal portion. A connecting bar has a first end swivelably attached to the rotatable member and a second end which extends downwardly from the rotatable member. The second end of the connecting bar extends through an opening in the practice golf ball and is attached to the ball. The length of the connecting bar which extends into the practice golf ball is adjustable so that the height of the ball from the base may be varied.

13 Claims, 6 Drawing Sheets

GOLF PRACTICE DEVICE

CROSS REFERENCE TO RELATED APPLICATIONS

The present application is a continuation-in-part of application Ser. No. 224,124 filed Jul. 25, 1988, which application was copending at the time of filing and has subsequently been abandoned, and the disclosure of which is incorporated herein by its entirety.

FIELD OF THE INVENTION

The present invention relates to an improved golf practice device. Practicing in accurate way with a suitable practice device is the most important factor for a golf player to acquire proficiency.

BACKGROUND OF THE INVENTION

Although there is a conventional golf practice device in current use, the golf player can only recognize if he hits the ball with a stroke and the player cannot easily determine the direction imparted to the ball for each stroke. This is useful for indicating accuracy and directional properties of the stroke. A computerized simulation practice device is very expensive and needs a large space. Its use is limited to a special place such as a business location and is not very popular.

Further. U.S. Pat. No. 2,929,632 which issued Mar. 22, 1970, entitled "Golf Practice Device", as illustrated in FIG. 1, is a relatively simple exercising device including an elongate base as the artificial golf course; an L-shaped support projecting upwardly; a pulley which is rotatably mounted on the outer end portion of the horizontal section of support; a flexible cord on the pulley; a lightweight captive plastic ball, of perforated construction is supported on the lower end of the cord. The disadvantage of this device are that the golf player can only recognize if he/she strikes the golf ball directly and cannot visually observe the exact driving direction of the golf ball. This is due to both the center of the pulley being coincidental with the upper end of the L-shape support and the light weight of the golf ball. These alter the direction of driving because of the reverse action of the cord and the return to the original state of the pulley after the golf ball is stroked.

U.S. Pat. No. 1,419,636 issued to MacDonald on Jun. 13, 1922 also teaches a practice apparatus for golf players. The apparatus comprises an elongated box in one end of which is a captive target such as a golf ball which is mounted in a stem and is struck by a golf club swung by the player. Beyond the target, and in the direction of movement of the club, is a secondary target to show how the player is following-through with the swing. The secondary target is in the form of a dumbbell, pivoted between the ends, which will spin in a plane indicative of the proper direction of the blow of the golf club. Another embodiment has a plurality of pivoted indicators through which the club mows a path after striking the target.

The applicant is also aware of UK Patent No. 1,263,269 issued to Hall on Feb. 9, 1972. The apparatus comprises a ball mounted on an arm which permits rotation of the ball when it is struck by a golf club. The arm includes a counting means and indicator for the projected distance the ball would travel. The arm also includes a braking means and an angular member. The latter has fingers remote from the arm which provide an indication as to whether or not the ball proceeded in the desired direction. The apparatus can also be used for practice of putting and includes a scale to indicate the length of the putt.

Thus, although the prior art has been in existence for many years, there is still no widely accepted practice device which enables a golf player to practice in a simple environment and which also demonstrates to the player the improper movement of the ball as a result of the player's striking a practice golf ball with a golf club.

SUMMARY OF THE INVENTION

A major object of the invention is to provide an improved golf practice device that can help the player observe both the real direction and the orbit of the golf ball.

Another object of the invention is to provide an improved golf practice device that can effectively rectify the player's stroke. A further object of the invention is to supply an improved golf practice device which is realistic and closely simulates actual play.

The present invention relates to an improved golf practice which can provide practicing skill in striking a golf ball, is relatively easy to assemble and is simple in operation. In order to simulate realistic practicing, the device is provided with a ball the exact size of an actual golf ball. The practice ball is connected by a bar to a rotatable apparatus. When the player strikes the practice ball, the practice ball and connecting rod rotate about a horizontal axis. The player can truly observe the real driving direction and the motion orbit of the golf ball. The player does not need to change his/her standing position because the golf ball will automatically return to the original position by the forces of gravity after the device stops revolving. The player can effectively correct and improve his/her skill in striking the golf ball by adjusting the holding position of the golf club and by adjusting his/her stance in stroking the ball.

In accordance with the teachings of the present invention there is disclosed a golf practice device for a player to improve the player's swing of a golf club by striking a practice golf ball and observing the controlled movement of the practice golf ball. The device includes a base, an adjustable upright support and means for suspending the practice golf ball from the support such that when the practice golf ball is struck by the golf club swung by the player, the practice golf ball rotates coaxially about the upright support and the golf practice ball returns to the original position. This occurs in a manner indicative of the accuracy and correctness of the player's swing of the golf club and enables the player to improve and correct his/her swing.

A member rotatable about a horizontal axis is mounted on the upright support. A connecting bar has a first end which is swivelably attached to the rotatable member and a second end which extends downwardly from the rotatable member. The second end has the practice golf ball attached thereto.

In a preferred embodiment the member rotatable about a horizontal axis comprises a cylindrical body having a first end and a second end. The first end is journally connected to the upright support and the body extends outwardly therefrom to permit horizontal rotation of the cylindrical body. The body further has an opening with edges thereon near the second end of the body in which the first end of the connecting bar is disposed. The first end of the connecting bar extends downwardly from the opening in the body such that when the practice golf ball is struck with the golf club, the connecting bar engages the edge of the opening causing the body to rotate. The connecting bar transmits force to the swivel connection such that the bar may be displaced from a vertical plane during rotation. The player may observe whether movement of the practice ball is out of a vertical plane so that correction of the player's swing may be made. These and other objects and advantages of the preferred and alternate forms of the invention will become apparent from the following description thereof, and from the accompanying drawing.

BRIEF DESCRIPTION OF THE DRAWINGS

FIG. 4-1 is a side view of the rotational movement of the practice golf ball and connecting bar following an improper stroke to the left.

FIG. 4-2 is a side view of swinging action of the practice golf ball before it stops moving, following an improper stroke as in FIG. 4-1.

FIG. 5-1 is a side view of the rotational movement of the practice golf ball and connecting bar following an improper stroke to the right.

FIG. 5-2 is a view of the swinging action of the practice golf ball before it stops moving, following an improper stroke as in FIG. 5-1.

FIG. 6-1 is a view of the correct circular rotation path of the golf ball of the present invention device following a proper stroke.

FIG. 6-2 is a view of the swing action of the golf ball before it stops moving following a proper stroke as in FIG. 6-1.

FIG. 7-1 is a perspective view of the golf practice ball and connecting bar.

FIG. 7-2 taken along the lines 7—7 of FIG. 7-1 is a first embodiment showing, in cross section, the connection of the golf practice ball to the connecting bar.

FIG. 7-3 taken along the lines 7—7 of FIG. 7-1 is a second embodiment showing in cross section, the connection of the golf practice ball to the connecting bar.

FIG. 7-4 taken along the lines 7—7 of FIG. 7-1 is a third embodiment showing in cross section, the connection of the golf practice ball to the connecting bar in which the ball may be secured at different locations on the flexible rubber rod and in which the rod is disposed to the maximum extent within the ball.

FIG. 8-1 is an enlarged side view of the embodiment of FIG. 7-4 showing, in cross section, the connection of the flexible rubber rod to the ball in which the ball may move on the rod and is shown adjacent to the securing means within the ball.

FIG. 8-2 is an enlarged side view of the embodiment of FIG. 7-4, showing in cross section, the connection of the flexible rubber rod to the ball in which the ball has moved upwardly on the rod after being struck by the golf club and further showing the direction of rotational and vertical movement of the ball.

DESCRIPTION OF THE PREFERRED EMBODIMENTS

Figure 1:
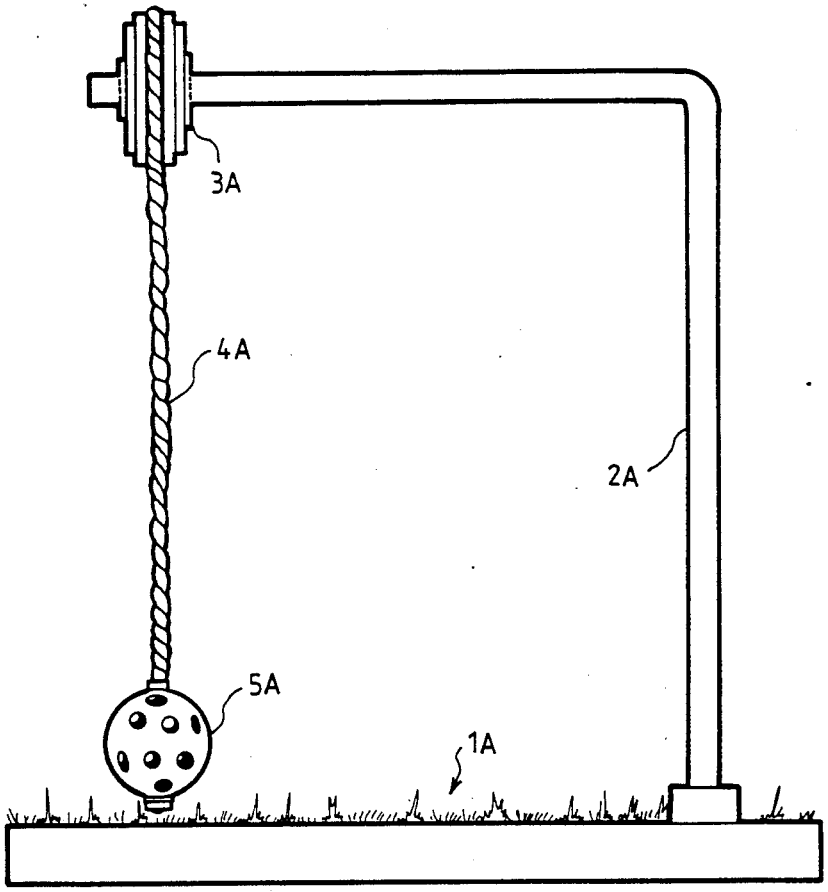
FIG. 1 PRIOR ART
FIG. 1 is a side view of a prior art golf practice device.

The present invention consists of an elongate base 1, an inverted L-shaped support 2 secured to the elongate base 1, a locking device 3 between the elongate base 1 and the L-shaped support 2, a rotatable member 4 mounted on the upper end of the L-shaped support 2, and a ball body 5 mounted loosely on the rotatable member 4.

Figure 2:
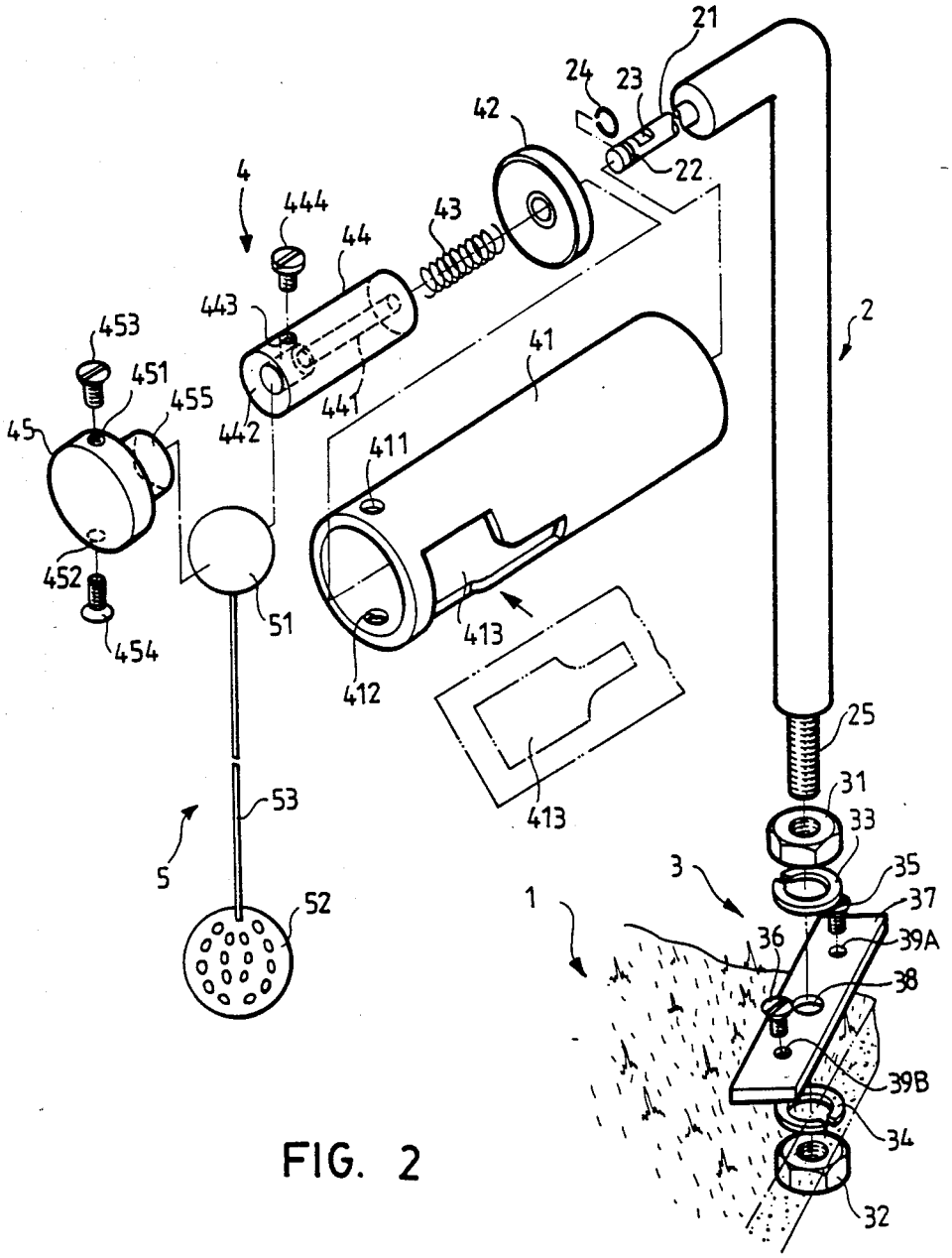
FIG. 2 is an exploded perspective view of the golf practice device of the present invention.
Figure 3:
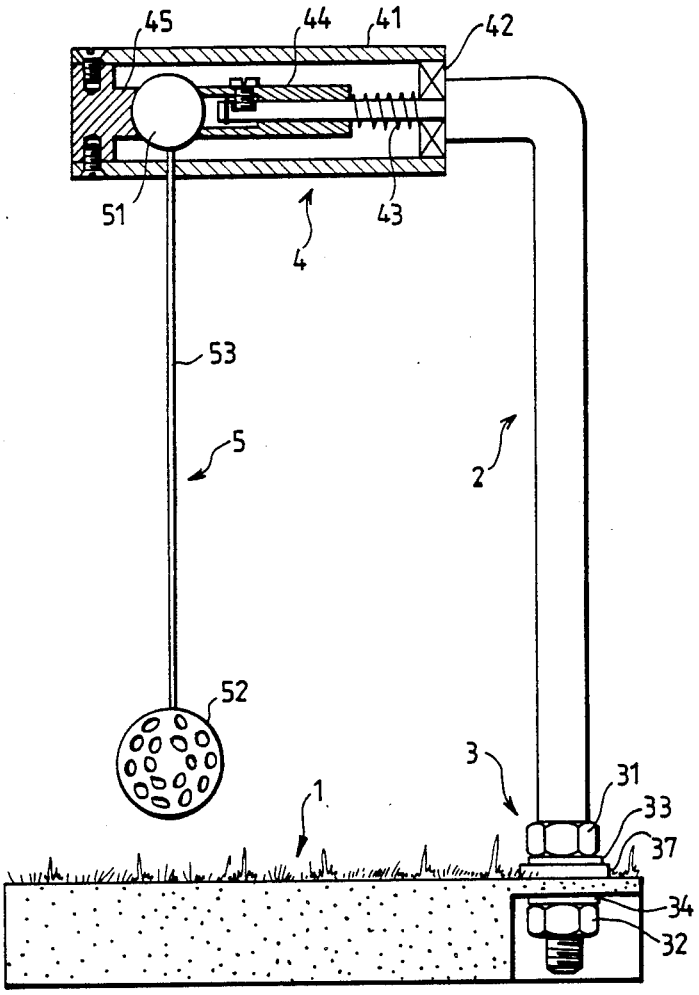
FIG. 3 is a side elevational view of the device with a sectional view of the rotational portion of the device.

As illustrated on FIGS. 2 and 3, the elongate base 1 of the present invention is a flat rectangular section covered with artificial grass. The base part 1 is constructed of high strength rubber matting on which the L-shape support 2 and the locking device 3 are mounted.

The L-shape support 2 is constructed of a one-piece-forged steel strip. Its upper end 21 has a smaller diameter with a circular groove 22 therein, a slot 23 located adjacent to the circular groove, and a spring washer 24 to cooperate with the circular groove 22. The lower end of the L-shaped support 2 has a threaded end which can adjust the height of the support and connect with the locking device 3 for securing the support to the elongate base 1.

The locking device 3 is constructed by two nuts 31, 32, two washers 33, 34, two screws 35, 36 and a sheet 37. It has a threaded hole 38 in the middle of the sheet 37, and two screw holes 39A, 39B at both sides. In assembling, the two screws are used for securing the sheet 37 into the elongate base 1. The nut 31 and the washer 33 are set on the upper portion of the threaded end portion 25; the nut 32 and the washer 34 are set on the lower portion of the threaded end portion 25.

The rotatable member 4 is cylindrical in shape and can be installed on the small diameter portion 21 of the L-shape support 2. It comprises a hollow cylindrical body 41, a bearing 42, a spring 43, a first support 44, and a second support 45. There are two openings 411, 412 on the edge of the cylinder and a T-shaped opening 413 adjacent to the two openings 411, 412. The bearing 42 is mounted directly on the small diameter portion 21, and the bearing 42 is disposed in the cylinder 41. The bearing 42 is welded to the cylinder 41 so that the cylinder 41 is journalled on, and revolves on the small diameter portion 21 of the L-shape support 2. The spring 43 is mounted about the small diameter portion 21 in front of the bearing. The first support 44 is cylindrical in shape and located about the small diameter portion 21 in front of the spring 43. Said first support 44 has a T-shape bore in the center portion which communicates with the small diameter portion 21 of the L-shape support 2. Cylinder 44 has a concave end 442. The center of the concave end 442 communicates with the larger opening of the T-shape bore in the cylinder 44. Near the end of the cylinder 44, there is a hole 443 which extends downwardly and communicates with the T-shape bore. A screw 444 is disposed through the hole 443 in the cylinder 44 to engage the slot 23. This screw 444 locks the first support 44 to the small diameter portion 21 of the L-shape support 2. The spring washer 24 is engaged in the circular groove 22. The outer diameter of the spring washer 24 is slightly smaller than the diameter of the head of the L-shaped bore in the cylinder 44 and thereby prevents removal of the cylinder 44 from the small diameter portion 21. It is very easy to disassemble the ball body 5 by loosening the screw 444 pushing the first support 44 against the urging of spring 43. The second support 45 is a T-shape cylinder, the larger diameter of the cylinder is provided with two screw holes 451, 452 and two matched screws 453, 454, to secure in the second support 45 of the cylindrical body 41. The end of the T-shaped cylinder 45 with the smaller diameter is concave 455 and together with concave 442 end of cylinder 44, a spherical space is provided for disposition of the ball 51.

Figures 1, 4:
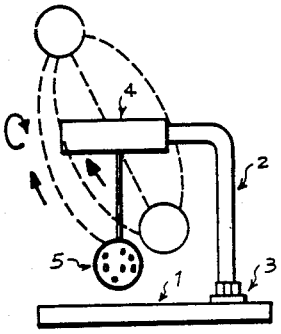
Figures 2, 4:
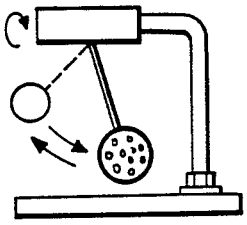
Figures 4, 7:
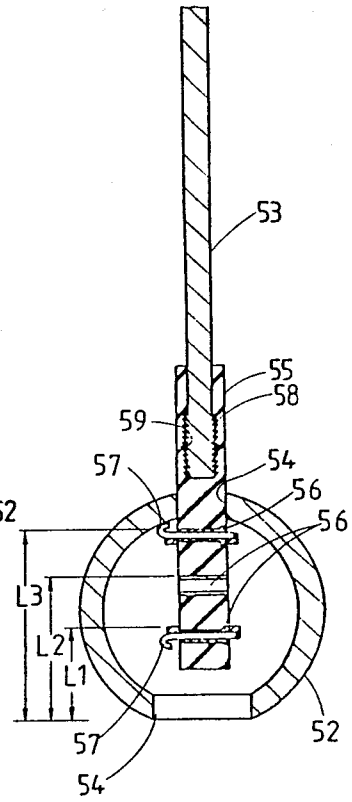
Figures 3, 7:
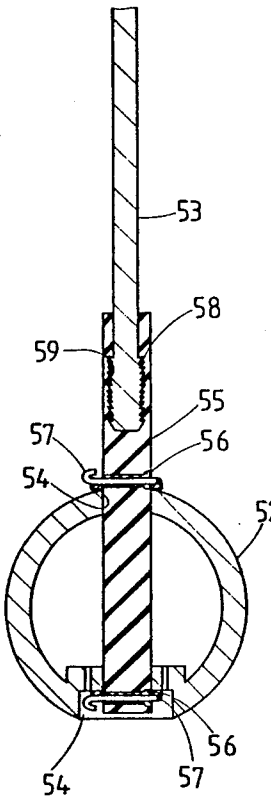
Figures 2, 7:
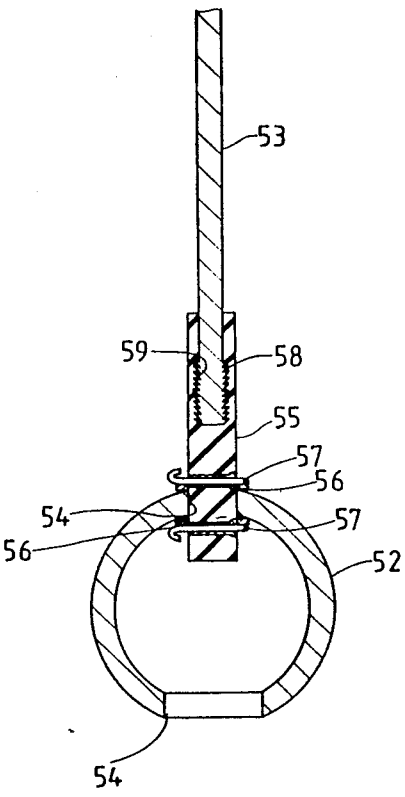
Figures 1, 7:
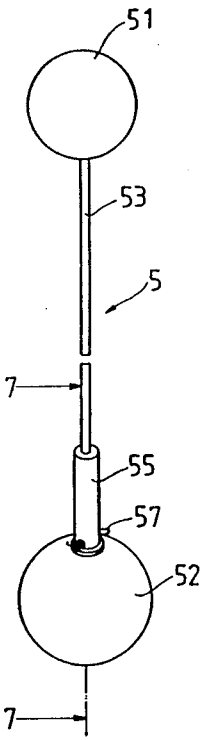
Figures 1, 2, 8:
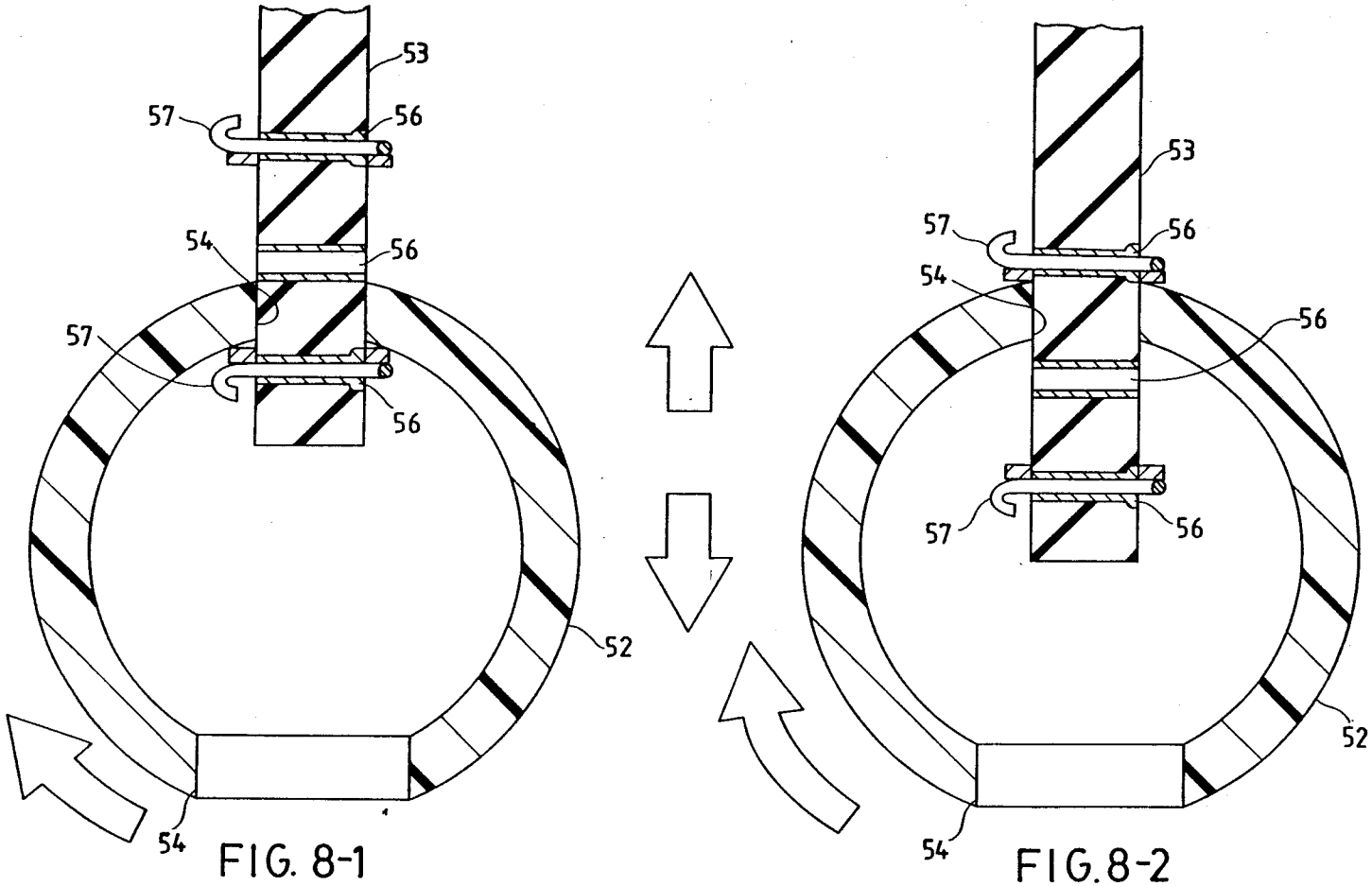

The ball body 5 comprises a steel ball 51, a golf practice ball 52 and a connecting bar 53. The first end 59 of the connecting bar 53 is threaded. The steel ball 51 is welded at the second end of the connecting bar 53, a golf practice ball 52 connected to the first end 59 of the bar 53. The steel ball 51, the golf practice ball 52 and the connecting bar 53 are linearly assembled as shown in FIGS. 7-1 through 7-4. In a preferred embodiment for general training (FIG. 7-2), the golf practice ball 52 is a hollow sphere with an inside and an outside and an opening at the top and the bottom 54. A flexible rubber rod 55 has a first end disposed in a friction fit through the top hole 54 into the inside of the hollow golf practice ball 52 and connected by a securing means. The flexible rubber rod 55 has spaced apart openings 54 bored transversely therethrough. One opening is near the end of the rod and a second opening is upwardly on the rod at a distance equal to the thickness of the ball ($1_1$ to $1_2$ in FIG. 7-4). A sleeve 56 is disposed in each opening in the rod and a pin means 57 (such as a cotter pin) is inserted in each sleeve. In this manner, the ball 52 is secured to the rod 55. The flexible rubber rod 55 has a threaded axial bore 58 in the second end which cooperates with the threaded end 59 of the connecting bar 53. This embodiment permits the initial shock of the stroke of the golf club to be partially absorbed by the flexible rubber. The opening 54 on the bottom of the ball 52 reduces the rotational speed of the ball 52 after it is struck by the golf club. In an alternate embodiment (FIG. 7-3), the spacing between the openings in the rod 55 are equal to the diameter of the practice ball 52. The first end of the flexible rubber rod 55 is disposed through the top and bottom openings 54 in the practice golf ball 52 and secured therein with sleeve 56 and pins 57. This embodiment provides a more secure connection between the flexible rubber rod 55 and the ball 52. In another embodiment (FIGS. 7-4, 8-1 and 8-2), the flexible rubber rod 55 has three (3) openings, the first one near the end of the rod 55, the second opening upwardly on the rod 55 at a distance equal to the thickness of the ball 52 (FIG. 7-4, $1_1$ to $1_2$) and the third opening upwardly from the second opening, also at a distance equal to the thickness of the ball 52 (FIG. 7-4, $1_2$ to $1_3$). Each opening has a sleeve 56 disposed therein. For general training and tee-off training, the player may secure the ball 52 between the first and third openings of the rod 55 by placing a pin means 57 in the first opening and placing another pin 57 in the third opening (FIGS. 8-1 and 8-2). In this manner, when the practice golf ball 52 is struck by the golf club, the ball 52 may move upwardly along the rod 55 to partially absorb the shock. The ball may move up to the upper pin 57 or only partially upwardly, depending upon the force of the stroke. As the ball 52 rotates, centrifugal forces cause the ball to return to the original position adjacent to the pin 57 which is disposed through the first opening in the rod 55. This embodiment also provides the option for the player to secure the ball 52 above the third opening in the rod such that all three openings in the rod 55 are disposed within the ball 52 (FIG. 7-4). This configuration permits the player to adjust the distance between the ball and ground level to simulate use of a tee.

The configuration of an opening through the rod 55 with a sleeve 56 and pin means 57 has been described, but persons skilled in the art recognize that alternate spaced apart means and securing means could be utilized to secure the ball 52 to the rod 55. Thus, a groove about the rod 55 which is engaged by a snap ring or other clamping means would be effective.

The ball 52 may be fabricated of metal such as steel, special rubber, plastic or combinations of these materials.

The steel ball 51 at the second end of the connecting bar 53 is swivelably mounted between the concave ends of the first support 44 and the concave end of the second support 45. When the player uses this device and strikes the golf practice ball 52, the connecting bar 53 of the ball body 5 will engage the circumferential rim of the T-shape opening and actuate the cylindrical body 41 to revolve accompanying the motion of the ball. Due to the fact that the steel ball 51 is held by the first support 44 and the second support 45, the ball body 5 can swivel in a direction of rotation which can be roughly classified into three types as follows:

1. As shown in FIGS. 4-1 and 4-2, an example of improper stroke to the left, both the golf practice ball 52 and the connecting bar 53 are revolving in the space of the second quadrant and the fourth quadrant whereby the rotational movement is in a plane angular to the horizontal axis. The connecting bar 53 actuates the steel ball 51 and initiates coaxial revolution of the rotatable member 4. Also, the ball body will swing in the revolving direction in the mode of a pendulum before it stops.

Figures 1, 5:
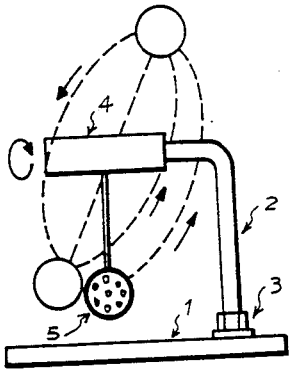
Figures 2, 5:
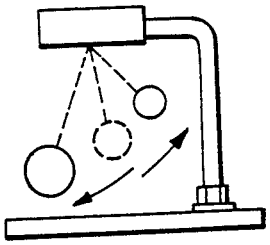

2. As shown in FIGS. 5-1 and 5-2, an example of improper stroke to the right, both the golf practice ball 52 and the connecting bar 53 are revolving in the space of the first quadrant and the third quandrant. The rotational movement is in a plane angular to the horizontal axis and displaced in an opposite direction from the rotational movement described in 1 above. The ball body 5 will swing in the revolving direction in the mode of a pendulum before it stops.

Figures 1, 6:
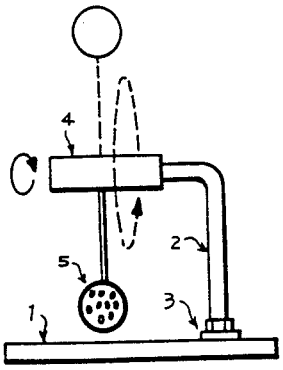
Figures 2, 6:
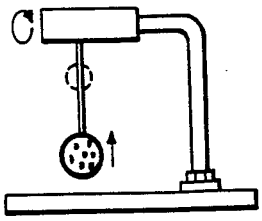

3. FIGS. 6-1 and 6-2, show an example of a proper stroke resulting in straight circular movement. Both the golf practice ball 52 and the connecting bar 53 are revolving in a plane along the Y-axis direction (perpendicular to the horizontal axis) and will swing along the vertical axis direction in the mode of pendulum before it stops. Since the motion orbit of the ball body is very clear and uninterrupted, the player can observe whether his/her stroke is correct from the motion direction of the golf practice ball 52 and the connecting bar 53. Furthermore, the ball body will stop revolving and start the swinging pendulum motion. This motion stops naturally after rotating 3 to 5 revolutions.

4. Due to the effect of gravity and friction resistance and the characteristics of the golf practice ball 52, the connecting bar 53 and the steel ball 51 which are linearly connecting, the player can effectively find the reason of the error in his/her strokes. By practice, the player can rectify his/her stance and swing by observing the orbit of the golf practice ball 52. In order to meet the player's stroking manner, the L-shape support 2 of the present invention is equipped with a height-adjusting feature which is very easy to adjust only by means of nuts 32 and 31. Also, it is relatively easy to replace the ball body in case of failure by moving the first support 44. Furthermore, the golf practice ball 52 can be replaced individually. The spring washer 24 and the screw 444 prevent sidewise moving of the first support 44 to provide greater safety in operation of the device.

Obviously, many modifications may be made without departing from the basic spirit of the present invention.

Accordingly, it will be appreciated by those skilled in the art that within the scope of the appended claims, the invention may be practiced other than has been specifically described herein.

What is claimed is:

1. A golf practice device for a player to improve the player's swing of a golf club by striking a practice golf ball and observing the controlled movement of the practice golf ball comprising:

a base, an inverted L-shaped support having an upright portion mounted in the base and having a horizontal portion on a horizontal axis and means for suspending the practice golf ball from the horizontal portion such that when the practice golf ball is struck correctly by the golf club swung by the player, the practice golf ball rotated about the horizontal portion, the rotational movement being in a vertical plane perpendicular to the horizontal axis of the horizontal portion and when the practice golf ball is struck incorrectly by the golf club, the rotational movement of the ball is in a plane angular to said horizontal axis and displaced in either direction off said perpendicular plane, returning to the original position in a manner indicative of the accuracy and correctness of the player's swing of the golf club to enable the player to improve and correct the player's swing.

2. The golf practice device of claim 1, wherein the means for suspending the practice golf ball from the horizontal portion comprises:

a member mounted on the horizontal portion, and rotatable about the horizontal axis, a connecting bar having a first end swivelably attached to the rotatable member and a second end extending downwardly from the rotatable member, the second end having the practice golf ball attached thereto.

3. The golf practice device of claim 2, wherein the member rotatable about the horizontal axis comprises a cylindrical body having a first end and a second end, the first end being journally connected to the horizontal portion of the inverted L-shaped support and the body extending outwardly therefrom to permit horizontal rotation of the cylindrical body, the body further having an opening with edges thereon near the second end of the body in which the first end of the connecting bar is swivelly connected, the first end of the connecting bar extending downwardly from the opening in the body such that when the practice golf ball is struck with the golf club, the connecting bar swivels and engages the edge of the opening causing the body to rotate; the connecting bar transmitting force to the swivel connection such that the bar may be displaced from the vertical plane during rotation, and the player may observe whether movement of the practice ball is out of the vertical plane so that correction of the player's swing may be made.

4. A golf practice device for a player to improve the player's swing of a golf club by striking a practice golf ball and observing the controlled movement of the practice golf ball comprising:

a base, an inverted L-shaped support having an upright portion mounted in the base and a horizontal portion and means for suspending the practice golf ball from the horizontal portion such that when the practice golf ball is struck by the golf club swung by the player, the practice golf ball rotates coaxially about the horizontal portion and the golf practice ball returns to the original position in a manner indicative of the accuracy and correctness of the player's swing of the golf club to enable the player to improve and correct the player's swing;

wherein the means for suspending the practice golf ball from the horizontal the horizontal portion comprises:

a member mounted on the horizontal portion rotatable about a horizontal axis, a connecting bar having a first end swivelably attached to the rotatable member and a second end extending downwardly from the rotatable member, the second end having the practice golf ball attached thereto; further comprising:

the practice golf ball being a sphere having a top and a bottom and further having a circular opening in the top and the bottom;

a length of flexible rubber rod having a first end received in the opening in the top of the practice golf ball and means for securing the rod therein, and a second end extending upwardly and attached to the second end of the connecting bar;

the second end of the flexible rubber rod further having a threaded bore therein; and the second end of the connecting bar having threads thereon, the threads cooperating with the threads in the bore in the flexible rubber rod such as to connect the flexible rubber rod and the practice golf ball to the connecting bar, the opening in the bottom of the ball further serving to reduce the rotational speed of the ball to facilitate return of the practice golf ball to the original position of the ball.

5. The golf practice device of claim 4, wherein the means for securing the flexible rubber rod to the practice golf ball comprises:

the practice golf ball being a hollow sphere having a thickness, an inside and an outside;

the first end of the flexible rubber rod having two spaced apart means thereon for receiving a securing means, the spaced apart means having a space therebetween equal to the thickness of the ball, such that one spaced apart means is disposed inside the ball and the second spaced apart means is disposed outside the ball; and the securing means is received thereto to firmly secure the ball to the flexible rod.

6. The golf practice device of claim 5, wherein the spaced apart means comprise:

the first end of the flexible rubber rod having two spaced apart openings bored transversely therethrough, a sleeve disposed in each opening in the rubber rod, the rod being received in the circular opening in the practice golf ball with a frictional fit such that one opening in the rubber rod is inside the golf ball and the second opening in the rubber ball is outside the golf ball; and the securing means being a pin means inserted in each sleeve such that the practice golf ball is thereby secured to the flexible rubber rod.

7. The golf practice device of claim 5, wherein the spaced apart means comprises:

the first end of the flexible rubber rod having three spaced apart openings bored transversely therethrough, the first opening adjacent to the end of the rubber rod, the second opening spaced upwardly therefrom by a distance equal to the thickness of the golf practice ball, the third opening spaced upwardly from the second opening by a distance equal to the thickness of the practice golf ball;

a sleeve inserted in each opening in the rubber rod, the rod being received in the circular opening in the practice golf ball with a frictional fit such that the first opening in the rubber rod is disposed inside the golf ball and the second and third openings in the rubber ball are outside the golf ball; a pin means inserted in the first sleeve inside the golf ball to secure the golf ball to the end of the flexible rod; and the securing means being a pin means inserted in the sleeve as desired by the player, whereby the pin means may be disposed in the second sleeve to firmly secure the practice golf ball to the end of the rubber rod, or the pin means may be disposed in the third sleeve such that the practice golf ball moves upwardly on the flexible rod when the practice golf ball is struck by the golf club and returns to rest against the pin means in the first sleeve during rotational movement of the practice golf ball.

8. The golf practice device of claim 7, wherein the practice golf ball is made of a material selected from the group consisting of metal, rubber, plastic and combinations thereof.

9. The golf practice device of claim 4, wherein the practice golf ball is made of a material selected from the group consisting of metal, rubber, plastic and combinations thereof.

10. The golf practice device of claim 4, further comprising the upright portion of the inverted L-shaped support having a threaded first end, the base having a top side, a lower side and an opening therein to receive the threaded first end of the upright portion, a threaded nut cooperating with the threaded upright portion disposed on the top side of the base, a threaded nut cooperating with the threaded upright portion disposed on the bottom side of the base such that the nuts secure the upright portion to the base and the length of the upright portion extending through the opening in the base may be varied to vary the height above the base of the horizontal portion of the inverted L-shaped support.

11. A golf practice device for a player to improve the player's swing of a golf club by striking a practice golf ball and observing the controlled movement of the practice golf ball comprising:

a base, an inverted L-shaped support having an upright portion mounted in the base and a horizontal portion and means for suspending the practice golf ball from the horizontal portion such that when the practice golf ball is struck by the golf club swung by the player, the practice golf ball rotates coaxially about the horizontal portion and the golf practice ball returns to the original position in a manner indicative of the accuracy and correctness of the player's swing of the golf club to enable the player to improve and correct the player's swing;

wherein the means for suspending the practice golf ball from the horizontal portion comprises:

a member mounted on the horizontal portion rotatable about a horizontal axis, a connecting bar having a first end swivelably attached to the rotatable member and a second end extending downwardly from the rotatable member, the second end having the practice golf ball attached thereto; further comprising:

the practice golf ball being a sphere having a top and a bottom and further having a circular opening in the top and the bottom;

a length of flexible rubber rod having a first end received in both openings in the practice golf ball and being secured in both openings, and a second end extending upwardly and attached to the second end of the connecting bar;

the second end of the flexible rubber rod further having a threaded bore therein; and the second end of the connecting bar having threads thereon, the threads cooperating with the threads in the bore in the flexible rubber rod such as to connect the flexible rubber rod and the practice golf ball to the connecting bar.

12. A golf practice device for a player to improve the player's swing of a golf club by striking a practice golf ball and observing the controlled movement of the practice golf ball comprising:

a base, an inverted L-shaped support having an upright portion mounted in the base and a horizontal portion and means for suspending the practice golf ball from the horizontal portion such that when the practice golf ball is struck by the golf club swung by the player, the practice golf ball rotates coaxially about the horizontal portion and the golf practice ball returns to the original position in a manner indicative of the accuracy and correctness of the player's swing of the golf club to enable the player to improve and correct the player's swing;

a member mounted on the horizontal portion rotatable about the horizontal axis, a connecting bar having a first end swivelably attached to the rotatable member and a second end extending downwardly from the rotatable member, the second end having the practice golf ball attached thereto;

wherein the member rotatable about a horizontal axis comprises a cylindrical body having a first end and a second end, the first end being journally connected to the horizontal portion of the inverted L-shaped support and the body extending outwardly therefrom to permit horizontal rotation of the cylindrical body, the body further having an opening with edges thereon near the second end of the body in which the first end of the connecting bar is disposed, the first end of the connecting bar extending downwardly from the opening in the body such that when the practice golf ball is struck with the golf club, the connecting bar engages the edge of the opening causing the body to rotate; the connecting bar transmitting force to the swivel connection such that the bar may be displaced from a vertical plane during rotation, and the player may observe whether movement of the practice ball is out of a vertical plane so that correction of the player's swing may be made;

the practice golf ball being a sphere having a top and a bottom and further having a circular opening in the top and the bottom;

a length of flexible rubber rod having a first end received in the opening in the top of the practice golf ball and being secured therein, and a second end extending upwardly and attaching to the second of the connecting bar;

the second end of the flexible rubber rod further having a threaded bore therein; and the second end of the connecting bar having threads thereon, the threads cooperating with the threads in the bore in the flexible rubber rod such as to connect the flexible rubber rod and the practice golf ball to the connecting bar, the opening in the bottom of the ball further serving to reduce the rotational speed of the ball to facilitate return of the practice golf ball to the original position of the ball.

13. A golf position device for a player to improve the player's swing of a golf club by striking a practice golf ball and observing the controlled movement of the practice golf ball comprising:

a base, an inverted L-shaped support having an upright portion mounted in the base and a horizontal portion;

a member mounted on the horizontal portion rotatable about a horizontal axis, a connecting bar having a first end swivelably attached to the rotatable member and a second end extending downwardly from the rotatable member, the second end having the practice golf ball attached thereto, wherein the member rotatable about the horizontal axis comprises a cylindrical body having a first end and a second end, the first end being journally connected to the horizontal portion of the inverted L-shaped support and the body extending outwardly therefrom to permit horizontal rotation of the cylindrical body, the body further having an opening with edges thereon near the second end of the body in which the first end of the connecting bar is swivelly connected, the first end of the connecting bar extending downwardly from the opening in the body such that when the practice golf ball is struck with the golf club, the connecting bar swivels and engages the edge of the opening causing the body to rotate; the connecting bar transmitting force to the swivel connection such that the bar may be displaced from a vertical plane during rotation, and the player may observe whether movement of the practice ball is out of the vertical plane so that correction of the player's swing may be made.

* * * * *